United States Patent [19]

La Beaud

[11] 4,057,275

[45] Nov. 8, 1977

[54] DOOR JAMB REINFORCING PLATE

[76] Inventor: Louis J. La Beaud, P.O. Box 50814, New Orleans, La. 70150

[21] Appl. No.: 709,147

[22] Filed: July 28, 1976

[51] Int. Cl.[2] ..... E05C 21/00

[52] U.S. Cl. ..... 292/340; 52/211; 49/504

[58] Field of Search ..... 292/346, 340; 52/211, 52/712; 49/504

[56] References Cited

U.S. PATENT DOCUMENTS

| | | | |
|---|---|---|---|
| 1,086,036 | 2/1914 | Ellis | 292/290 |
| 3,338,008 | 8/1967 | Sklar | 52/211 |
| 3,918,207 | 11/1975 | Aliotla | 49/504 |
| 3,967,845 | 7/1976 | Governale | 292/346 |

*Primary Examiner*—Richard E. Moore
*Attorney, Agent, or Firm*—James B. Lake, Jr.

[57] ABSTRACT

An elongated metal plate for fastening to the back of a wooden door jamb with a plurality of fastenings including an angled side of the plate recessed into the jamb, another angled penetrating side driven into the jamb, and a plurality of screws driven through the metal plate intermediate the recessed and penetrating sides. The fastenings are longitudinally and transversely spaced apart to provide maximum reinforcing strength without a concentration of the plurality of fastenings sufficient to weaken the wooden jamb where its bulk has been reduced by hollowing to receive a latch bolt. After the metal plate has been fastened to the back of the jamb, the jamb is fixed to blocking structure of a doorway with the metal plate therebetween and out of reach of tampering. As reinforced by a locked door in the doorway, the whole jamb must be broken transversely against its wood grain in order to force the door.

5 Claims, 3 Drawing Figures

DOOR JAMB REINFORCING PLATE

BACKGROUND OF THE INVENTION

The invention relates generally to breaking in locked doors, and more particularly to a metal reinforcing plate for wooden door jambs for strengthening a structurally weakened part thereof.

A door jamb provides a hollow space in which a latch bolt of a door can be engaged to lock the door against opening. The hollow space is close to an edge of a jamb leaving only a thin layer of wood to break away in order to force entry. A striker plate mounted around the hollow and fastened by screws adjacent thereto further weakens the jamb. A shoulder thrust or a hard kick is usually sufficient to break the jamb and open the door.

The prior art teaches reinforcing the door jamb with a metal plate fastened to the front of the jamb and usually including a striker plate. More screw fastenings and screw holes adjacent the jamb hollow for a latch bolt add little to the strength of the jamb, and finished surfaces have to be recessed for their installation. See E. R. Lamphere, U.S. Pat. No. 3,815,945; F. M. Sushan, U.S. Pat. No. 3,405,962 and 3,290,081; A Barone U.S. Pat. No. 3,279,840.

SUMMARY OF THE INVENTION

It is an object of the invention to provide a reinforcing plate for application to the back of a door jamb for strengthening it at its weakest part and for the distribution of forces applied thereto to stronger and more extensive portions of the door jamb.

Another object of the invention is to provide a plurality of various types of fastenings that are staggered both longitudinally and transversely to prevent splitting the wooden door jambs.

A further object of the invention is to provide an internally mountable reinforcing metal plate that is tamper proof and requires no recessing of finished surfaces to install.

DETAILED DESCRIPTION

Figure 1:
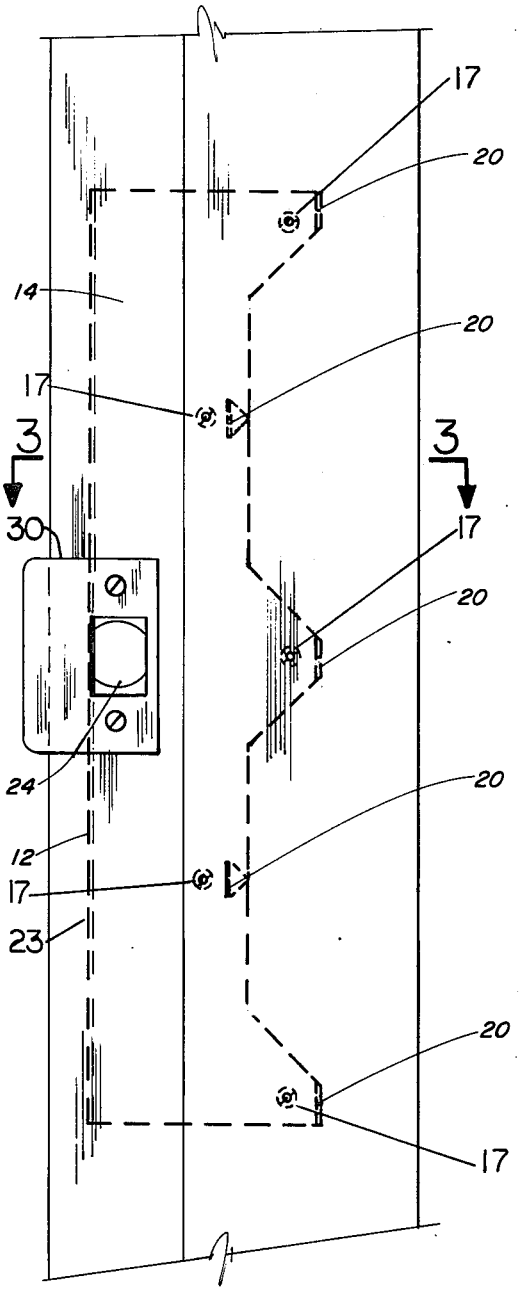
FIG. 1 is a view of the door jamb showing a plan view of the reinforcing metal plate mounted behind the jamb.
Figure 2:
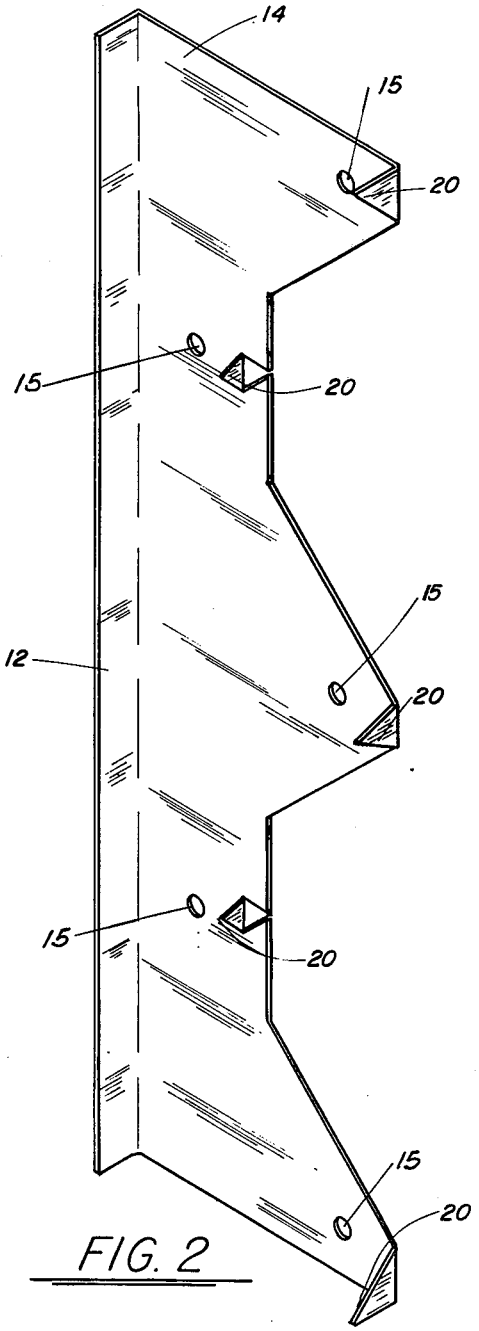
FIG. 2 is a view in three dimensions of the reinforcing metal plate.
Figure 3:
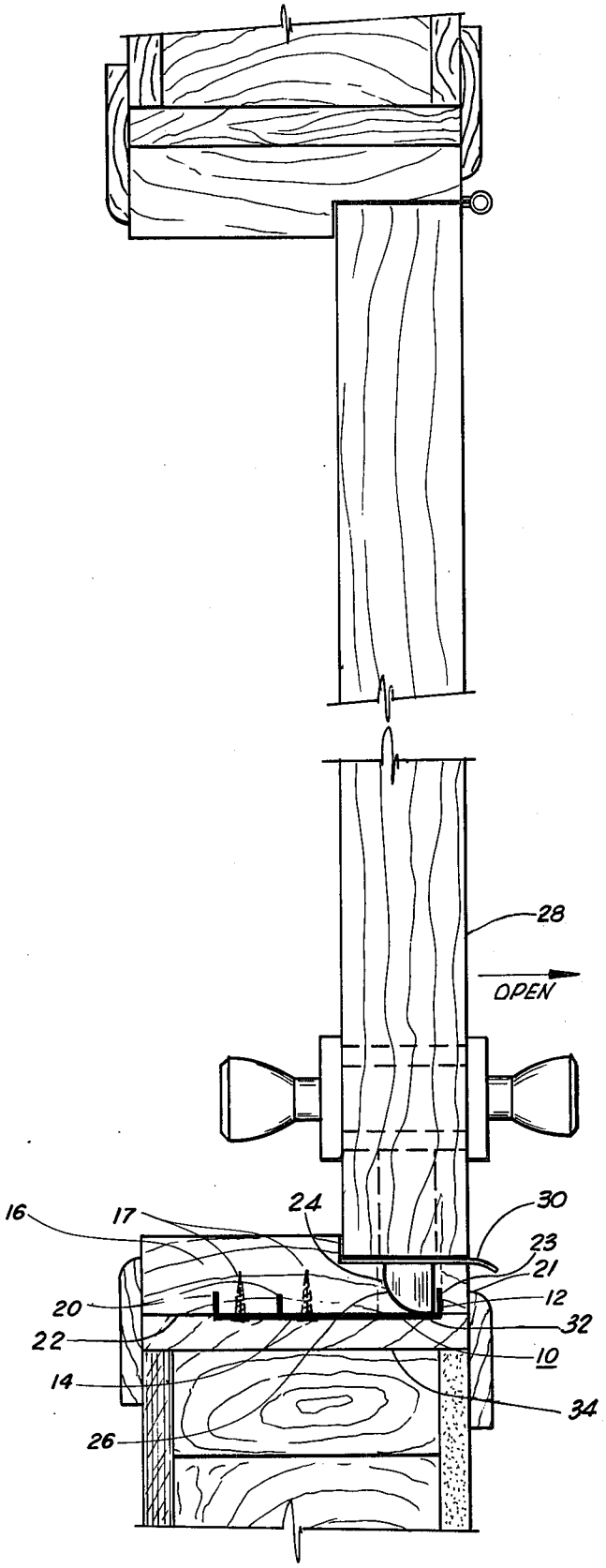
FIG. 3 is a cross sectional view taken along section lins 3—3 of FIG. 1, and including a similarly sections opposing jamb and a door between the sectioned jambs.

Referring to FIGS. 1–3, the invenion comprises a metal plate 10 shaped to have a narrow continuous side 12 of constant width and normal along a common longitudinal edge to a second wider side 14 of variable width that defines a plurality of transversely staggered and longitudinally spaced fastening holes 15 for fixing said metal plate 10 to the back of a wood jamb 16 by fastening 17. A third discontinuous side comprises a plurality of triangular points 20 parallel to side 12 and transversely staggered as shown in FIGS. 1 and 2 for preventing the jamb from splitting when driven therein. The latch bolt side 21 of jamb 16 is longitudinally recessed from its back 22 to provide a recess 23 for receiving side 12 for the full length of metal plate 10 that extends above and below a hollow space 24 provided in said jamb 16 for receiving a latch bolt 26 operably mounted in a door 28 adapted to engage with jamb 16. A striker plate 30 is mounted across hollow space 24 and around it to engage latch bolt 26 and is positioned as shown in FIG. 3 normal to side 12 which extends outboard of latch bolt 26.

In use, the metal plate 10 is fastened by means of the transversely staggered triangular points 20 and fastenings 17 to the back 22 of door jamb 16 with side 12 being received in recess 23 and side 14 against the back of said jamb 16 and fitting into a complementary recess 32 in blocking 34 supporting said jamb, plate 10 being fastened to the jamb and the jamb to blocking 34.

What is claimed is:

1. In combination with a doorway having wooden jambs and a door adapted to swinging inwardly and outwardly therebetween, each jamb with an oppositely disposed front and back, and one jamb defining a hollow in front for receiving a latch bolt of said door, a jamb protector for said one jamb comprising: a reinforcing plate having two contiguous sides with a common longitudinal edge defining a ninety degree angle between said sides, a first and narrower of said two sides for recessing into the back of said one jamb and outwardly, as said door swings, in said hollow and the second and wider of said two sides, defining a plurality of fastening holes, for placing against the the back of said one jamb; a third and discontinuous side parallel and opposite to the first and narrower side and defined by a plurality of longitudinally spaced triangular points for penetrating into the back of said one jamb; and a plurality of individual fastenings adapted to engage through said fastening holes into the back of said one jamb, whereby the reinforcing plate is fixed to the back of said one jamb against separation therefrom in all directions by each side and strengths the jamb against splitting, splintering and kick-outs in attempts to force said door.

2. A jamb reinforcing plate as described in claim 1 wherein said second and wider side defines said plurality of fastening holes transversely staggered and longitudinally spaced to form parallel rows of staggered holes for providing a greater plurality of fastenings without danger of splitting said jamb.

3. A jamb reinforcing plate as described in claim 1 wherein said second and wider side varies in width to define said triangular points, transversely staggered and longitudinally spaced to form parallel rows of staggered triangular points for providing a greater plurality of triangular points without danger of splitting said jamb.

4. A jamb reinforcing plate as described in claim 1 wherein said fastening holes and said triangular points are transversely spaced apart respectively for providing mixed pairs of holes and triangular points in fixing said reinforcing plate to the back of said one jamb without unduly weakening said jamb.

5. A method of reinforcing a wooden door jamb defining a latch-bolt-receiving hollow comprising the steps of:

a. fastening a reinforcing plate having an angled side to the back of said jamb with said angle side recessed into said back and through said latch-bolt-receiving hollow for the strengthening of said hollow and the engagement of said latch-bolt; and b. fixing said jamb, back to back to structural blocking, for preventing tampering with said reinforcing plate and its fastenings.

* * * * *